United States Patent [19]

Bachrach et al.

[11] Patent Number: 4,612,944

[45] Date of Patent: Sep. 23, 1986

[54] COMB

[75] Inventors: Frank Bachrach, Great Neck, N.Y.; James M. Teale, Woodcliff Lake, N.J.

[73] Assignee: American Comb Corporation, Paterson, N.J.

[21] Appl. No.: 703,429

[22] Filed: Feb. 20, 1985

[51] Int. Cl.[4] ..... A45D 24/00

[52] U.S. Cl. ..... 132/11 R; 132/159

[58] Field of Search ..... 132/11 R, 126, 137, 132/138, 142, 152, 159, DIG. 1, 1 R; 15/159 A

[56] References Cited

U.S. PATENT DOCUMENTS

| | | | |
|---|---|---|---|
| Re. 22,035 | 2/1942 | Huppert | 132/137 |
| 757,042 | 4/1904 | Ingram | 132/100 |
| 893,242 | 7/1908 | Homeier | 132/154 |
| 1,255,601 | 2/1918 | Hare | 43/134 |
| 1,305,226 | 5/1919 | Kunkler | 132/11 |
| 1,576,041 | 3/1926 | Du Priest | 132/158 |
| 1,642,916 | 9/1927 | Anderson | 132/163 |
| 1,670,161 | 5/1928 | Meyer | 132/137 |
| 1,958,802 | 5/1934 | Seaman | 132/125 |
| 2,206,365 | 7/1940 | Pieper | 132/152 |
| 2,236,446 | 3/1941 | Pucci | 132/160 |
| 2,276,886 | 3/1942 | Smith | 128/297 |
| 2,305,969 | 12/1942 | Larson | 132/18 |
| 2,317,485 | 4/1943 | Rider | 15/159 A |
| 2,395,002 | 2/1946 | Kemmer | 132/18 |
| 2,626,618 | 1/1953 | Collison | 132/20 |
| 2,655,925 | 10/1953 | Ulvad | 132/18 |
| 3,057,367 | 10/1962 | Langley | 132/161 |
| 3,125,776 | 3/1964 | Lilley | 132/159 |
| 3,216,428 | 11/1965 | Hallnan | 132/136 |
| 3,312,583 | 4/1967 | Rochlis | 15/159 A |
| 3,317,641 | 5/1967 | Takai | 15/159 A |
| 3,797,506 | 3/1974 | Reinsch | 132/137 |
| 4,206,771 | 6/1980 | Heinlein | 132/11 R |
| 4,502,498 | 3/1985 | Saferstein | 132/137 |

*Primary Examiner*—Robert Peshock

*Attorney, Agent, or Firm*—Arthur Dresner

[57] ABSTRACT

A comb for removing lice and nits from the hair is formed by a base and a plurality of teeth extending from said base in substantially the same direction. The longitudinal axis of each tooth is parallel to the longitudinal axis of each other tooth. Each tooth has a polygonal cross section shape such as in the form of a diamond. The cross sectional dimensions of each tooth enlarge from the free end of each tooth toward the base so that the spacing between adjacent teeth narrows toward the base. The facing edges of adjacent teeth interact with each other to capture, in a scissor-like manner, lice and nits therebetween.

9 Claims, 11 Drawing Figures

COMB

FIELD OF THE INVENTION

The present invention relates generally to the field of combs and more particularly to a comb having uniquely designed teeth particularly useful for removing lice and nits from hair.

BACKGROUND OF THE INVENTION

Heretofore lice combs have been formed simply by spacing adjacent teeth very close together so that lice or nits would be caught in the narrow space between adjacent teeth. The design of the teeth of such lice combs have typically been no different than the designs of teeth of any other styling type comb having a cross sectional shape which has traditionally been oval or sometimes rectangular. While this type of lice comb has been somewhat effective, there has always been the danger of not being able to remove all of the unhatched eggs or all of the hatched eggs of lice from the hair as a result of the eggs slipping through the comb in the space between adjacent teeth since such teeth typically have flat or slightly curved opposing faces.

Recent attempts at overcoming the disadvantages of the prior lice comb designs have involved creating teeth with portions that overlap into the spacing between adjacent teeth so as to further narrow this spacing. The result has been combs having teeth with complicated cross sectional shapes thus making the creation of molds for producing plastic combs complicated and expensive. In addition, such design tends to render the teeth susceptible to easy breaking.

It is accordingly a principal object of the present invention to provide a comb useful for removing lice and nits from hair which generally overcomes the disadvantages of the prior art.

A more specific object of the present invention is to provide such a comb having teeth which are diamond in cross sectional shape in which the cross sectional dimensions of such teeth enlarge toward the base of the comb so that spacing between facing edges of adjacent teeth continually narrows to assure catching all lice and nits.

Yet a further object of the present invention is to provide a comb having teeth with interacting adjacent facing edges which serve to capture in a scissor-like manner lice and nits.

Other objects, features and advantages of the present invention will become more apparent from the detailed description of the invention in conjunction with the accompanying drawings to be described more fully hereinafter.

SUMMARY OF THE INVENTION

The foregoing objects of the present invention are generally accomplished by providing a comb for removing lice and nits from the hair formed by a base and a plurality of teeth extending from said base in substantially the same direction with the longitudinal axis of each tooth being parallel to the longitudinal axis of each other tooth. Each of the teeth has a diamond cross sectional shape. The cross sectional dimensions of each tooth enlarge from the free end of each tooth toward the base so that the spacing between adjacent teeth narrows toward the base. The edges of adjacent teeth thus interact to capture in a scissor-like manner lice and nits.

BRIEF DESCRIPTION OF THE DRAWINGS

The foregoing and other features of the present invention are more fully described with reference to the following drawings annexed hereto, in which.

DESCRIPTION OF THE INVENTION

Figure 1:
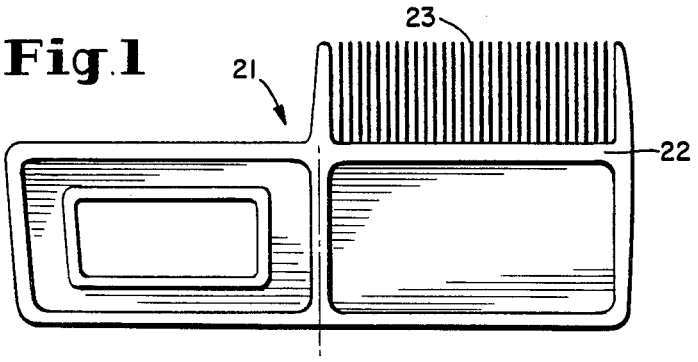
FIG. 1 is a side elevational view illustrating one form of a comb incorporating one embodiment of the present invention.
Figure 2:
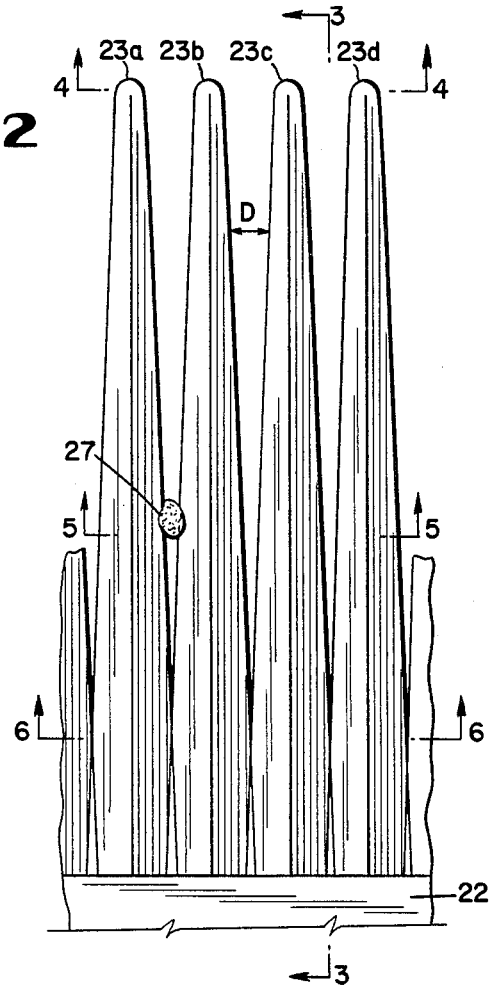
FIG. 2 is an enlarged side elevational view showing in detail some of the teeth of the embodiment of FIG. 1.

FIG. 1 illustrates a comb 21 incorporating the features of one embodiment of the present invention, which is generally formed by a base 22 and a plurality of teeth 23 which extend vertically upward as illustrated in FIG. 1 away from the base 22. The design of the teeth 23 which renders the present invention particularly effective is more clearly illustrated in FIGS. 2 through 6. FIG. 2 shows in an enlarged view teeth 23*a*, 23*b*, 23*c* and 23*d* extending from base 22 and aligned adjacent to each other. The longitudinal axis of each of these teeth is arranged parallel to each other. This is more clearly illustrated in FIG. 4 showing that the plurality of teeth are aligned.

Figure 3:
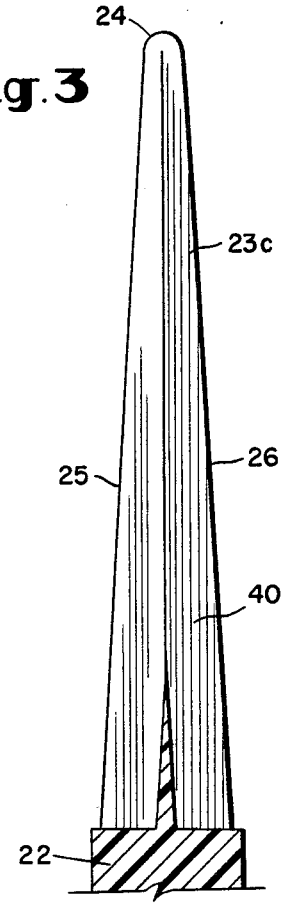
FIG. 3 is a sectional view taken along lines 3—3 of FIG. 2.
Figure 4:
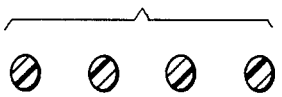
FIG. 4 is a sectional view taken along lines 4—4 of FIG. 2.

From FIGS. 2 and 3 it will also be noted that the top 24 of each of the teeth 23 is rounded in order to avoid any injury to the user.

Figure 5:
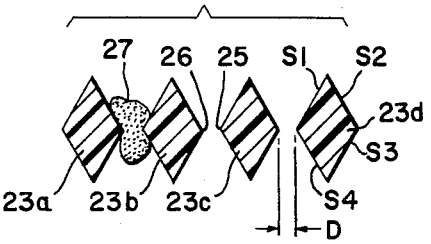
FIG. 5 is a sectional view taken along lines 5—5 of FIG. 2.
Figure 6:
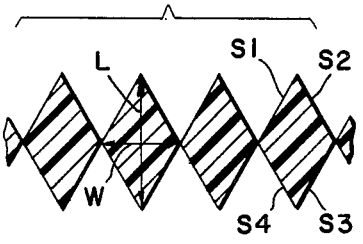
FIG. 6 is a sectional view taken along lines 6—6 of FIG. 2.

FIGS. 5 and 6 illustrate that the cross sectional shape of the teeth shown in this embodiment is substantially diamond shaped, each having longitudinal side surfaces S1, S2, S3, S4. Each tooth has a length dimension L and a width dimension W. It will be noted by comparing FIG. 5 with FIG. 6 that both the length L and the width W of each tooth increases from the top 24 toward the base 22. Accordingly, the edge 25 of intersecting sides S1 and S4 will meet the edge 26 of intersecting sides S2 and S3 of each tooth at a point above the base 22 which is a distance of approximately twenty percent of the total length of the teeth from the base. The intersecting position is shown in FIG. 6. In this manner, the distance D (see FIG. 2) between adjacent teeth will continually decrease from the top 24 toward the base 22 until a point is reached where the space between adjacent teeth is actually zero, thus creating a scissor-like effect to capture lice and nits.

When in use, the user will pass the comb through his hair in an attempt to catch lice and nits 27 between the edges of adjacent teeth. The edges 25 and 26 of adjacent teeth thus serve to capture the lice or nit particles without danger of these particles slipping past the side surfaces of the teeth. The surfaces 40 of each face of each tooth may have a rough texture in order to impede the movement of any lice or nits across its surface.

Figure 7:
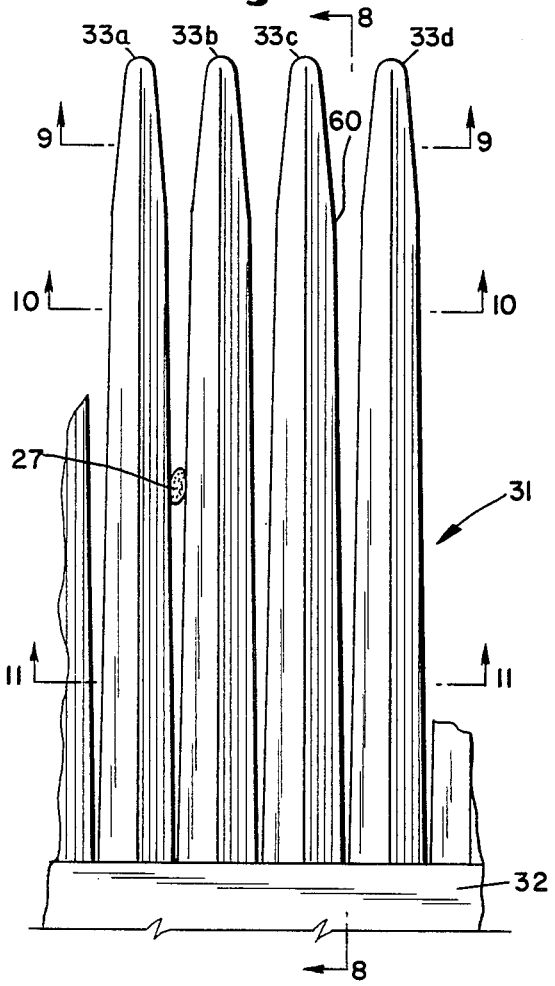
FIG. 7 is an enlarged side elevational view illustrating a further embodiment of the present invention.
Figure 8:
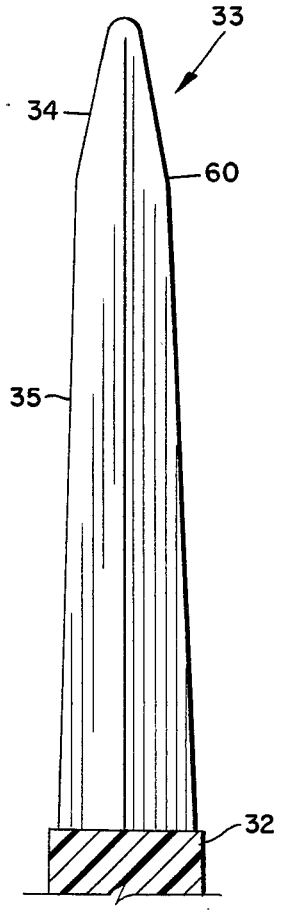
FIG. 8 is a sectional view taken along lines 8—8 of FIG. 7.

Turning now to the embodiment illustrated in FIGS. 7 through 11, another form of lice comb 31 is also formed by a base 32 and a plurality of teeth 33, which similarly extend from the base 32 in a vertically upward direction as seen in FIGS. 7 and 8.

As in the previously described embodiment the teeth 33 in this embodiment extend away from base 32 with their axes generally perpendicular to a plane forming the base of each tooth.

Figure 9:
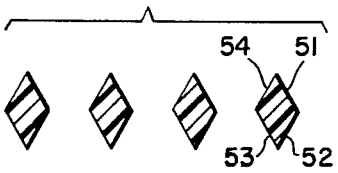
FIGS. 9, 10 and 11 are sectional views taken along lines 9—9, 10—10 and 11—11 respectively of FIG. 7.

Each tooth 33 has an upper tapered section 34 and a lower tapered section 35. Upper section 34 has a diamond cross sectional shape as illustrated in FIG. 9. The upper section thus has side walls 51, 52, 53 and 54 which taper from the transition point 60, between the upper and lower sections, to the rounded tip of the tooth in a four sided pyramidal pattern.

Figure 10:
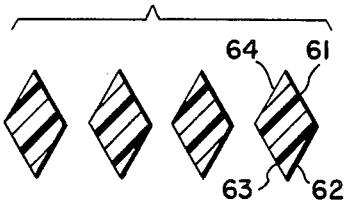
Figure 11:
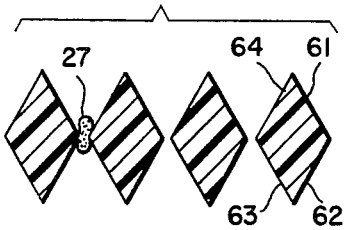

In a similar manner the lower section has side walls 61, 62, 63 and 64 which are also arranged in a four sided pyramid pattern, also producing a diamond cross sectional shape, as illustrated in FIGS. 10 and 11. The angle formed between the surface of the side walls of the lower section with a plane forming the base of the pyramid is greater than the corresponding angle of the upper section. In this manner the spacing between upper sections of adjacent teeth is sufficiently great to help guide hairs therebetween into the zone of the space between the lower sections.

At the base of the teeth, the spacing between facing edges of adjacent teeth is no greater than 0.002 inches, while the spacing between these facing edges at the point of transition 60 between the upper and lower sections is between 0.005 inches and 0.009 inches. This produces a comb in which both lice and nits will be caught between the sharp facing edges of adjacent teeth in a scissor-like manner since the size of such particles is greater than the spacing therebetween.

While the foregoing invention has been described and illustrated with respect to certain embodiments which provide satisfactory results, it will be appreciated, by those skilled in the art, after understanding the principles of the present invention, that various changes and modifications may be made without departing from the spirit and scope of the present invention, and it is therefore intended to cover all such changes and modifications in the appended claims.

What is claimed is:

1. A comb for removing lice and nits from hair comprising a base, a plurality of teeth extending substantially in the same direction away from the base, the longitudinal axis of each tooth being parallel to the longitudinal axis of each other tooth and substantially the same length, each said tooth having a polygonal cross sectional shape, the sides of each such cross sectional polygon increasing in length from the free end of each tooth toward the base, so that the spacing between adjacent teeth narrows toward said base, each of the sides of each cross sectional shape of each tooth converging at a rounded top of each tooth, said rounded top having a cord smaller in length than the width of said tooth at any point along its length, said polygonal cross sectional shape being diamond shaped so that said teeth form a four sided pyramid, the side walls of each diamond shaped tooth meeting to form an edge at the intersection thereof, said teeth being arranged on said base so that two opposite edges of each tooth lie in a plane passing through the corresponding opposite edges of each other tooth.

2. The comb according to claim 1 wherein facing edges of adjacent diamond shaped teeth which lie in said plane meet at a point approximately twenty percent of the length of said teeth from the base so that at said point the spacing between facing edges of adjacent teeth diminishes to zero.

3. The comb according to claim 1 wherein side walls of each face of each tooth has a non-smooth surface.

4. The comb according to claim 1 wherein facing edges of adjacent diamond shaped teeth which lie in said plane are spaced apart at the base thereof.

5. The comb according to claim 4 wherein said space is no more than 0.002 inches.

6. The comb according to claim 5 wherein said facing edges are spaced apart at the free end thereof by between 0.005 inches and 0.009 inches.

7. The comb according to claim 6 wherein said teeth comprise an upper section and a lower section, each section having a diamond cross sectional shape, said sections having their longitudinal axes aligned, said sections meeting at a transition point.

8. The comb according to claim 7 wherein the slope of the side walls of the upper section is greater than the slope of the side walls of the lower section.

9. The comb according to claim 8 wherein facing edges of adjacent diamond shaped teeth which lie in said plane and spaced apart at said transition by 0.007 inches and at the base by 0.002 inches.

* * * * *